US012035816B2

(12) United States Patent
Nelson

(10) Patent No.: US 12,035,816 B2
(45) Date of Patent: Jul. 16, 2024

(54) IN-CASE PORTABLE CHAIR

(71) Applicant: Lerrlyn Nelson, Detroit, MI (US)

(72) Inventor: Lerrlyn Nelson, Detroit, MI (US)

( * ) Notice: Subject to any disclaimer, the term of this patent is extended or adjusted under 35 U.S.C. 154(b) by 15 days.

(21) Appl. No.: 18/533,075

(22) Filed: Dec. 7, 2023

(65) Prior Publication Data

US 2024/0108141 A1 Apr. 4, 2024

Related U.S. Application Data

(63) Continuation-in-part of application No. 15/929,368, filed on Apr. 28, 2020.

(51) Int. Cl.
*A47C 4/52* (2006.01)

(52) U.S. Cl.
CPC ..... *A47C 4/52* (2013.01)

(58) Field of Classification Search
CPC ..... A47C 4/52
USPC ..... 4/611
See application file for complete search history.

(56) References Cited

U.S. PATENT DOCUMENTS

| | | | | |
|---|---|---|---|---|
| 3,674,306 | A * | 7/1972 | Botney | A47C 4/52 297/183.5 |
| 3,909,061 | A * | 9/1975 | Johnson | A47D 1/023 297/17 |
| 4,193,630 | A * | 3/1980 | Steele | A47D 1/0081 16/362 |
| 5,335,377 | A | 8/1994 | Masyada et al. | |
| 5,845,962 | A | 12/1998 | Lin | |
| D411,054 | S | 6/1999 | Williams | |
| D550,002 | S | 9/2007 | Genord et al. | |
| D812,389 | S | 3/2018 | Pong | |
| 2017/0347841 | A1 | 12/2017 | Nera et al. | |
| 2020/0054139 | A1* | 2/2020 | Morley, Jr. | A47C 1/16 |

* cited by examiner

*Primary Examiner* — Huyen D Le
(74) *Attorney, Agent, or Firm* — NEXUS LAW PLLC; Leonard Raykinsteen

(57) ABSTRACT

A foldable chair includes a seat member having a front side for supporting a user and a back side, a backrest member having a front surface for supporting the user and a back surface, and a plurality of legs. Each of the legs is pivotably connected to the back side of the seat member and each leg is adapted to pivot from a folded configuration where each leg is generally parallel to the back side of the seat member to an unfolded configuration where each leg is generally transverse to the back side of the seat member. The backrest member is configured to hingedly engage the seat member and to selectively enclose at least the back side of the seat member to form a portable case.

18 Claims, 5 Drawing Sheets

IN-CASE PORTABLE CHAIR

CROSS REFERENCE TO RELATED APPLICATION

The present application is a continuation-in-part of application Ser. No. 15/929,368, filed Apr. 28, 2020, which is hereby incorporated herein by reference in its entirety.

FIELD OF THE INVENTION

The present invention relates in general to foldable chairs, and more particularly to a foldable chair configured to fold into and form a portable travel case.

BACKGROUND OF THE INVENTION

A foldable chair is a type of chair that is designed to be folded and transported, making it more convenient than a regular chair for outdoor activities, camping, picnics, sporting events, and other situations where one needs a portable seating solution. Many of the portable chairs provide a space-saving solution for various settings, including homes, offices, and events. These chairs can be folded and stored away when not in use. However, conventional foldable/folding chairs are still generally large and bulky and not very convenient for storage. Even those with conventional adjustable legs and/or foldable or collapsible configurations, still have relatively large dimensions, particularly the height dimension, even when in a retracted or folded condition for storage. Moreover, conventional foldable or folding chairs are typically too large to conveniently carry and easily transport.

There are also specialized seating arrangements designed for individuals who need assistance or support while, for example, showering. Particularly, such assistance is needed for the individuals with mobility issues or disabilities. It is well known that it may be difficult for many elderly, frail and/or psychically challenged individuals to have access to bathing facilities such as a bathtub especially when traveling away from home. Although there are existing shower chairs or seats that are designed to be used in the shower or bath area and provide a safe and comfortable seating solution, many are not readily storable when not in use, nor are they designed for easy carrying when traveling. The various specialized seating arrangements are still generally large and bulky and not very convenient for storage, such as for example in the bathroom, to be readily available for assisting fragile, elderly or disabled people to take a shower. This lack of portability may create a problem in small bathrooms (such as those that are usually found in apartments or hotels rooms) or when traveling or staying away from home.

Therefore, there is a need for a generally comfortable, easy-to-use, and convenient-to-store chair that folds into a compact dimension that is easy to carry for use in various situations and conditions, including as a specialized seating arrangement for those who are physically challenged.

SUMMARY OF THE INVENTION

The following presents a simplified summary in order to provide a basic understanding of some aspects of the invention. The summary is not an extensive overview of the invention. It is neither intended to identify key or critical elements of the invention nor to delineate the scope of the invention. The following summary merely presents some concepts of the invention in a simplified form as a prelude to the description that follows.

The long-standing but heretofore unfulfilled need for a foldable or specialized chair that is configured to fold into and form a portable travel case and that overcomes the limitations of prior art foldable chairs is now met by a new, useful and non-obvious invention of the present disclosure. The present invention provides a foldable chair that is comfortable, stable, very convenient for travel, highly compact for storage, and well-suited for various situations and conditions. Particularly, the foldable chair of the present disclosure is useful for those users who are elderly, frail and/or psychically challenged and who require a highly compact seating arrangement for bathing or showering.

In one form of the present invention, the foldable chair includes a seat member having a front side for supporting a user and a back side, a backrest member having a front surface for supporting the user and a back surface, and a plurality of legs, each of the legs is pivotably connected to the back side of the seat member and each leg is adapted to pivot from a folded configuration where each leg is generally parallel to the back side of the seat member to an unfolded configuration where each leg is generally transverse to the back side of the seat member. The backrest and seat members are configured to selectively form a portable case by the backrest member hingedly engaging the seat member to enclose at least the back side of the seat member According to one aspect, each of the plurality of legs includes a leg extension selectively slidable therein from a collapsed position to a deployed position.

According to another aspect, the foldable chair further includes a main lock assembly connected to the back side of the seat member and operable to lock and unlock the legs in the folded and unfolded configurations.

According to a further aspect, each of the legs includes a leg lock assembly configured to interact with the main lock assembly and operable to lock and unlock respective one of the leg extensions in the collapsed and deployed positions.

According to yet a further aspect, the foldable chair further includes a first set of control cables, each cable of the first set of control cables extending from the main lock assembly to respective one of the plurality of legs.

According to yet another aspect, the foldable chair further includes a second set of control cables, each cable of the second set of control cables extending from the main lock assembly to respective one of the leg lock assemblies.

According to still a further aspect, the main lock assembly includes a main lock lever that can be selectively rotated from a closed position to an open position to unlock the legs in the folded and unfolded configurations and unlock the leg extensions in the collapsed and deployed positions.

According to still another aspect, the foldable chair further includes a lock release lever that can be selectively pressed to lock the legs in the folded and unfolded configurations and lock the leg extensions in the collapsed and deployed positions.

According to yet another aspect, the lock release lever, when the main lock lever is in the open position, can be pressed to actuate the main lock lever to move from the open position to the closed position causing the main lock assembly to lock the legs in the folded and unfolded configurations and lock the leg extensions in the collapsed and deployed positions.

According to still another aspect, the backrest member, when each of the plurality of legs is in the folded configuration and respective one of the leg extensions is in the collapsed position, can hingedly engage the seat member to enclose the plurality of legs between the back side of the seat member and the back surface of the backrest member.

In another form of the present invention, the foldable chair includes a seat member having a front side for supporting a user and a back side, a backrest member having a front surface for supporting the user and a back surface, and a plurality of leg assemblies pivotably connected to the back side of the seat member, each of the leg assemblies including a leg extension slidable from a collapsed position to a deployed position, wherein each of the leg assemblies is adapted to pivot from a folded configuration where each leg is generally adjacent and parallel to the back side of the seat member to an unfolded configuration where each leg is generally transverse to the back side of the seat member. The backrest and seat members are configured to selectively form a portable case having the leg assemblies in the folded configuration therein by the backrest member hingedly engaging the seat member to cover at least the back side of the seat member.

In yet another form of the present invention, the foldable chair includes a seat member having a front side for supporting a user and a back side, a backrest member having a front surface for supporting the user and a back surface, a plurality of leg assemblies pivotably connected to the back side of the seat member, each of the leg assemblies including a leg extension slidable from a collapsed position to a deployed position, wherein each of the leg assemblies is adapted to pivot from a folded configuration where each leg is generally adjacent and parallel to the back side of the seat member to an unfolded configuration where each leg is generally transverse to the back side of the seat member, and a main lock assembly connected to the back side of the seat member and operable to lock and unlock the leg assemblies in the folded and unfolded configurations and operable to lock and unlock the leg extensions in the deployed and collapsed positions. The backrest and seat members are configured to selectively form a portable case having the leg assemblies in the folded configuration therein by the backrest member hingedly engaging the seat member to cover at least the back side of the seat member.

Aspects of the present specification disclose a foldable chair that is convenient to use for elderly or physically challenged individuals to shower and for anyone else to use for outdoor activities if needed, and that can be folded into and form a portable travel case that is easy to transport and does not require much space for storage. These and other objects, advantages, purposes and features of the present invention will become apparent upon review of the following specification in conjunction with the drawings.

BRIEF DESCRIPTION OF THE DRAWINGS

The drawings are not necessarily to scale and, in some instances, proportions have been exaggerated in order to more clearly depict certain features of the invention.

DETAILED DESCRIPTION OF PREFERRED EMBODIMENTS

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout. Throughout this disclosure, unless the context dictates otherwise, the word "comprise" or variations such as "comprises" or "comprising," is understood to mean "includes, but is not limited to" such that other elements that are not explicitly mentioned may also be included. Further, any terms expressed in the singular form herein are meant to also include the plural form and vice versa, unless explicitly stated otherwise. Also, as used herein, the term "a" and/or "an" shall mean "one or more," even though the phrase "one or more" is also used herein.

Figure 1:
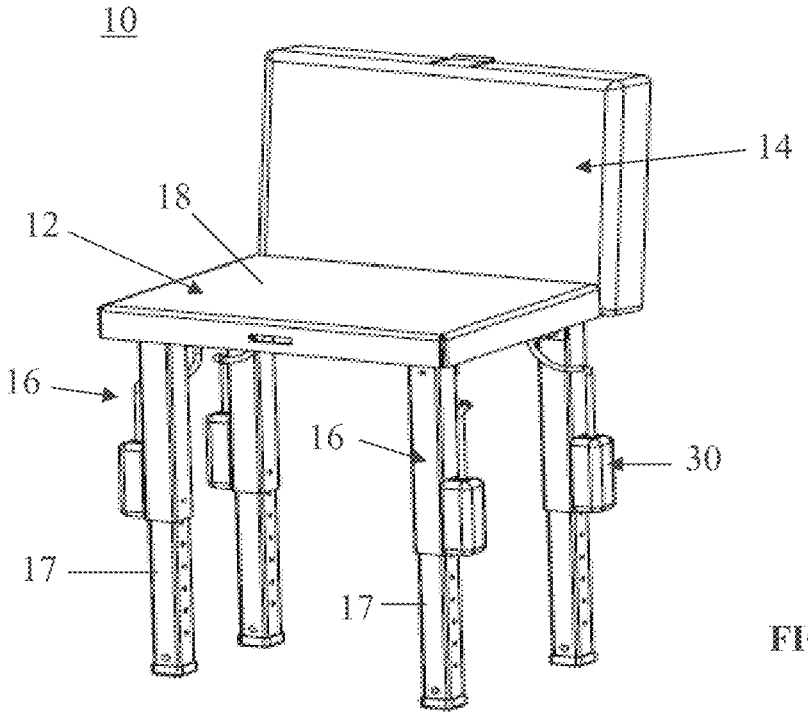
FIG. 1 is a perspective view of a foldable chair with unfolded legs and deployed leg extensions, in accordance with an embodiment of the present invention.

Referring now to the drawings and the illustrative embodiments depicted therein, wherein like components are designated by like reference numerals throughout the various figures, a foldable chair 10 of the present invention configured to collapse, fold into and form a portable case for carrying and/or storage is illustrated in FIG. 1. The foldable chair 10, which is preferably made from a lightweight but rigid material such as aluminum, plastic, carbon fiber or a combination thereof, includes a seat member 12, a backrest member 14 and a plurality of leg assemblies 16.

Figure 2:
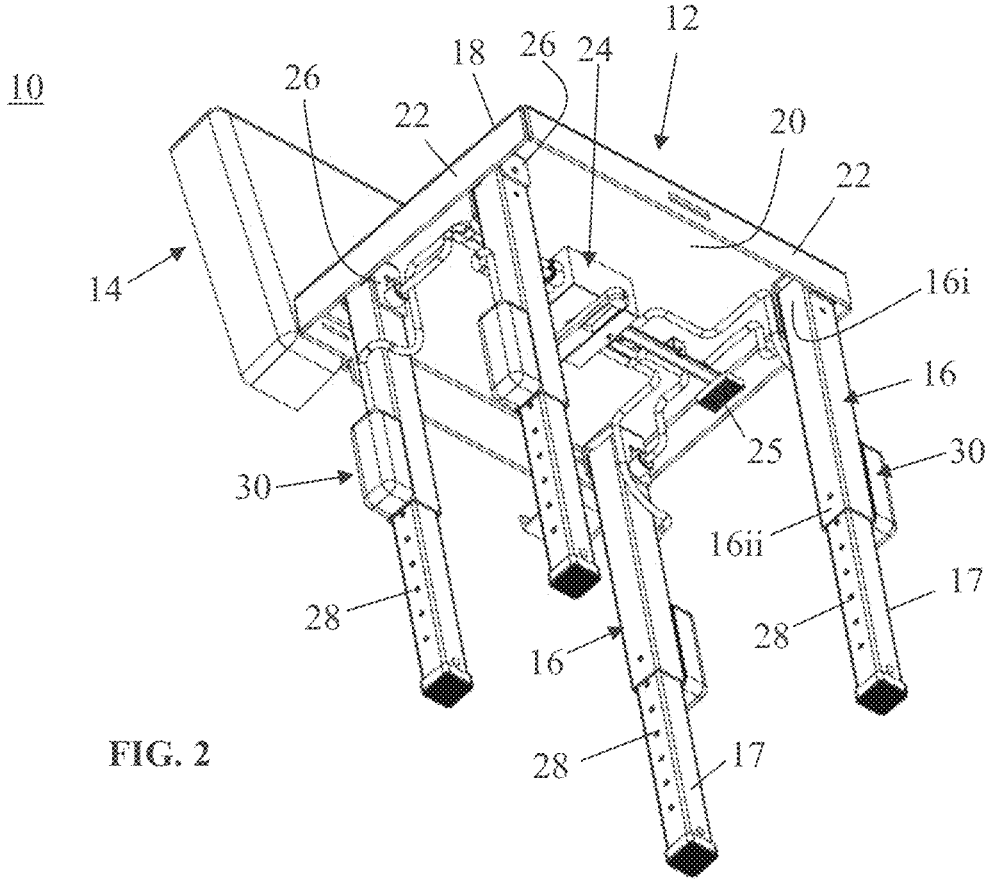
FIG. 2 is a bottom perspective view of the foldable chair illustrated in FIG. 1.
Figure 3:
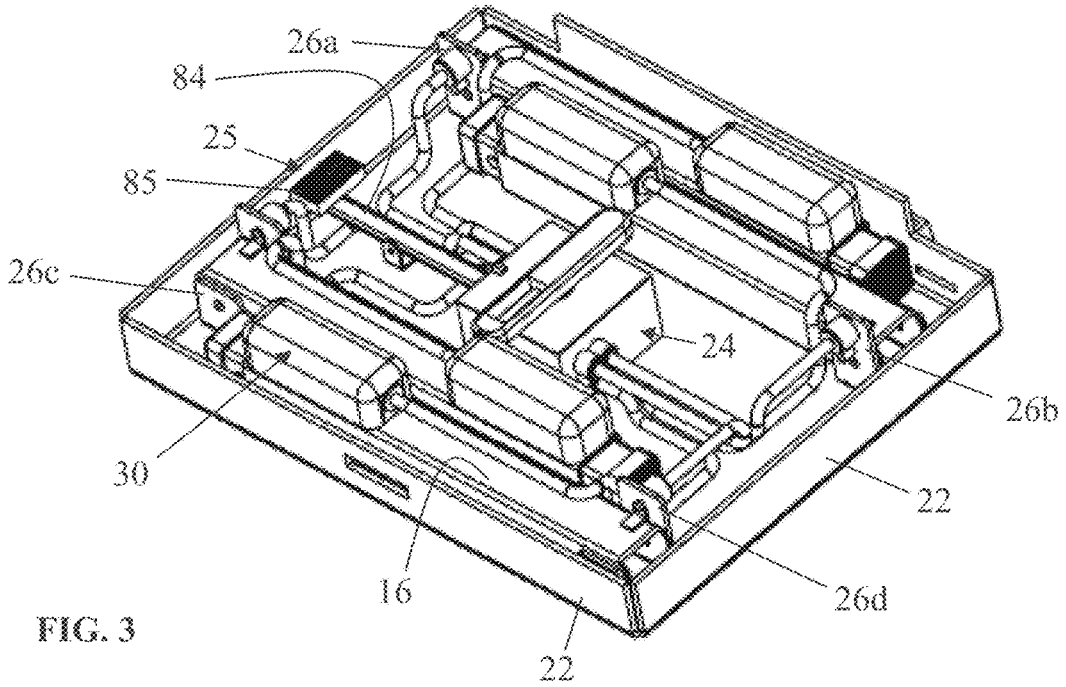
FIG. 3 is a top perspective view of the foldable chair illustrated in FIG. 2, the foldable chair is shown as being flipped over, without a backrest member and with folded legs and collapsed leg extensions.
Figure 4:
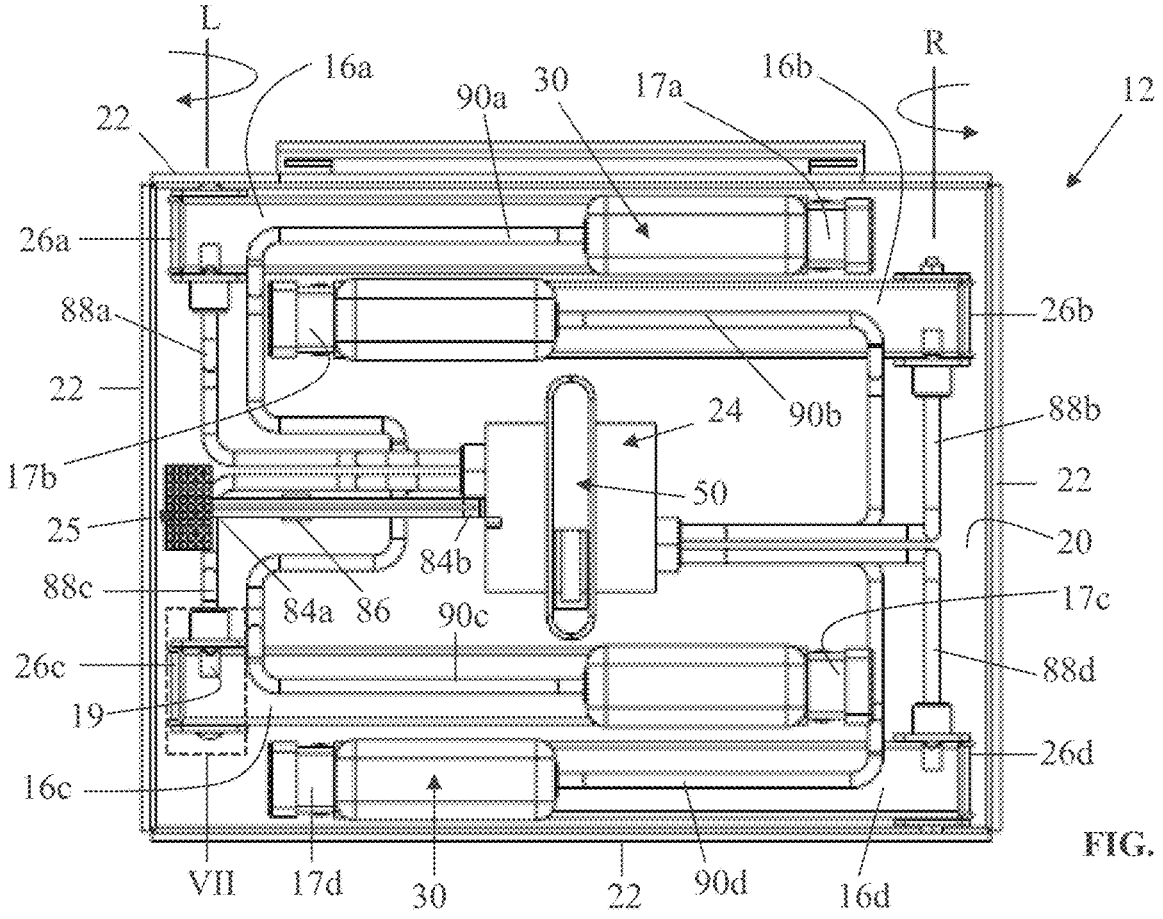
FIG. 4 is a top plan view of the foldable chair illustrated in FIG. 3.

With reference to FIGS. 1-4, the seat member 12 has a front surface 18 configured to support a user (not shown), a back surface 20 and a plurality of sidewalls 22 (FIGS. 2-4). The sidewalls 22 extend along a perimeter of the seat member 12 and orthogonally extend a distance from the front surface 18 to entirely surround the back surface 20 and to form a cavity therebetween. Preferably, the seat member 12 is shaped as a rectangle or square and configured to serve as a first half of a portable case 100, shown in FIGS. 10 and 11, as will be described in more detail below.

With reference to FIGS. 2-4, securely connected to the back surface 20 of the seat member 12 are a main lock assembly 24, a lock release lever 25 and a plurality of hinge brackets 26. Each hinge bracket 26 has respective one of the plurality of leg assemblies 16 pivotably secured thereto such that each leg assembly 16 can pivot relative to respective one of the hinge brackets 26 either to a folded configuration, in which each leg assembly 16 is generally adjacent and parallel to the back surface 20, and to an unfolded configuration, in which each leg assembly 16 is transverse to the back surface 20. In the illustrated embodiment, the seat member 12 has a rectangular shape and there are four hinge brackets 26*a*, 26*b*, 26*c* and 26*d* and corresponding four leg assemblies 16*a*, 16*b*, 16*c* and 16*d* (FIG. 4) to provide for optimal stability of the seat member 12. It will be appreciated that each of the leg assemblies 16*a-d* is pivotably connected to respective one of the hinge brackets 26*a-d*, and that when the leg assemblies 16*a-d* are in the folded configuration, the sidewalls 22 surround or encircle the leg assemblies 16*a-d*.

As can be best seen in FIG. 4, to ensure that each of the leg assemblies 16*a-d* can pivot into the folded configuration, the hinge brackets 26*a* and 26*d* are secured in respective opposite corners of the back surface 20, while the hinge brackets 26*b* and 26*c* are secured along opposite sides of the back surface 20 and shifted a distance away from the remaining two corners of the back surface 20. As such, the hinge bracket 26*a* is disposed opposite to the hinge bracket 26*b*, and the hinge bracket 26*c* is disposed opposite to the hinge bracket 26*d*. Accordingly, as shown in FIG. 4, when each of the leg assemblies 16*a-d* is in the folded configuration, leg assemblies 16*a* and 16*b* are generally adjacent, parallel and extending in opposite directions relative to one another, and leg assemblies 16*c* and 16*d* are generally adjacent, parallel and extending in opposite directions relative to one another.

It will be understood that, when each of the leg assemblies 16*a-d* is in the folded configuration, the leg assemblies 16*a-d* are generally coplanar relative to one another and adjacent to the to the back surface 20 of the seat member 12, such as shown in FIG. 3. It will be also noted that leg assemblies 16*b* and 16*d* pivot to the unfolded configuration by rotating around axis R, as shown in FIG. 4, and leg assemblies 16*a* and 16*c* pivot to the unfolded configuration by rotating around axis L, as shown in FIG. 4. It should be further noted that, in an alternative embodiment, the positioning of the hinge brackets 26*a-d* described above may differ without departing from the spirit and scope of the present invention.

With reference now to FIGS. 1, 2 and 4, each leg assembly 16*a-d* includes a respective leg extension 17*a*, 17*b*, 17*c* and 17*d*, each of which is configured to slidably move within and longitudinally along respective one of the leg assemblies 16*a-d*. In the illustrated embodiment, the slidable leg extensions 17*a-d* are in a telescoping connection with the respective leg assemblies 16*a-d*, though other suitable connection types can also be envisioned. Each leg extension 17*a-d* includes a plurality of positioning holes 28 (FIG. 2) for selectively receiving a spring-biased locking pin, described in more detail below. Accordingly, each of the leg extensions 17*a-d* can be conveniently locked in a selected position in relation to the respective leg assemblies 16*a-d*, such as for example for height adjustment of the foldable chair 10.

It will be understood that, when the leg assemblies 16*a-d* are in the folded configuration, each of the leg extensions 17*a-d* is preferably collapsed, i.e., inserted or sheathed into respective one of the leg assemblies 16*a-d*, such as shown in FIGS. 3 and 4. When the leg assemblies 16*a-d* are in the unfolded configuration, the leg extensions 17*a-d* can be deployed, such as shown for example in FIGS. 1 and 2. As shown in FIG. 2, each of the leg assemblies 16*a-d* includes a proximal end 16*i* and a distal end 16*ii*, and the proximal end 16*i* of each of the leg assemblies 16*a-d* is pivotably secured to respective one of the hinge brackets 26*a-d*.

As shown in FIGS. 1-4, the distal end 16*ii* of each leg assembly 16*a-d* further includes a leg lock assembly 30, which as described in more detail below, functions to either lock the leg extensions 17*a-d* when they are deployed and at a height suitable for the user or unlock the leg extensions 17*a-d* so that they can freely move within respective leg assemblies 16*a-d* to be collapsed or farther deployed. Additionally, as best shown in the illustrative embodiments of FIGS. 4 and 7, the proximal end 16*i* of each leg assembly 16*a-d* includes a catch member 19 that serves to fasten or secure each of the respective leg assemblies 16*a-d* in the folded configuration, as will be described in more detail below. As can be best seen in the illustrative embodiment of FIG. 7, it should be apparent that each hinge bracket 26*a-d* has a U-shape with one arm 27 being substantially longer than another arm and having a hinge bracket neck 29 leading into a hole 31 therethrough.

Figure 5A:
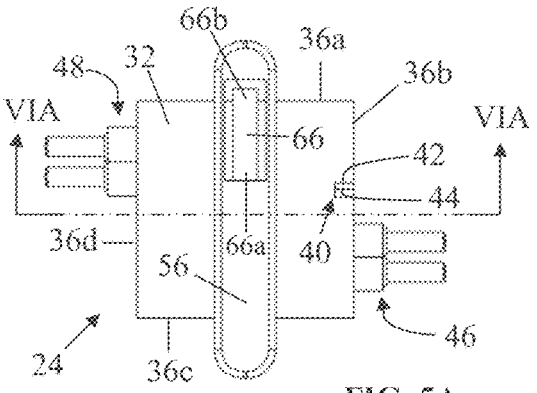
FIG. 5A is a top plan view of a main lock assembly with a main lock lever being in a closed position, in accordance with the present invention.

Turning now to FIGS. 5A-6B, the main lock assembly 24 that serves as a controller for locking and unlocking the leg assemblies 16*a-d* and leg extensions 17*a-d* will now be described in more detail. In the illustrated embodiment, the main lock assembly 24 is a generally square or rectangular housing that has a first wall 32, a second wall 34 (FIG. 6A, 6B) and a plurality of sidewalls 36*a*, 36*b*, 36*c* and 36*d* (FIGS. 5A, 5B) between and connecting the first and second walls 32, 34 to form a hollow interior chamber 35 (FIG. 6A). The first wall 32 includes a generally central, circular opening 38 (FIG. 5D) into the interior chamber 35, and an outer surface of the first wall 32 includes a main lock tab 40 that protrudes from the outer surface of the first wall 32 and near sidewall 36*b*. The main lock tab 40 is rigid and stationary and has a sloped side surface or ramp 42 leading to a ridge portion 44 (FIG. 5A).

Figure 5B:
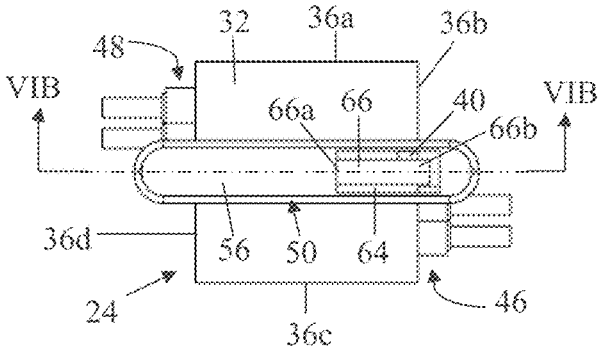
FIG. 5B is a top plan view of the main lock assembly illustrated in FIG. 5A, with the main lock lever shown in an open position.
Figure 5C:
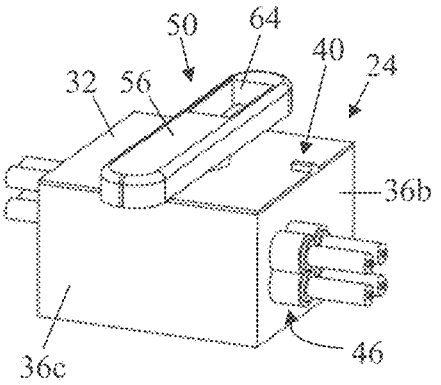
FIG. 5C is a top perspective view of the main lock assembly illustrated in FIG. 5A.
Figure 5D:
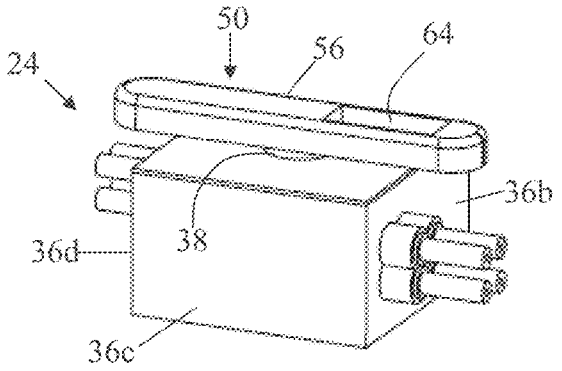
FIG. 5D is a top perspective view of the main lock assembly illustrated in FIG. 5B.

Further, as shown in the illustrated embodiment of FIGS. 5A and 5C, sidewall 36*b* has a cluster of four round collars 46 extending from the sidewall 36*b* and each being adjacent with one another, and sidewall 36*d* has a cluster of four round collars 48 extending from the sidewall 36*d* and each being adjacent with one another. Each of the round collars of the clusters 46 and 48 has a through hole (not shown) leading into the interior chamber 35 of the main lock assembly 24. It should be noted that the cluster 46 is disposed or shifted off-center of the sidewall 36*b* towards the sidewall 36*c*, and the cluster 48 is disposed or shifted off-center of the sidewall 36*d* towards the sidewall 36*a*, and that the clusters 46 and 48 are symmetrically diagonal with one another, as shown in FIG. 5A.

Figure 6A:
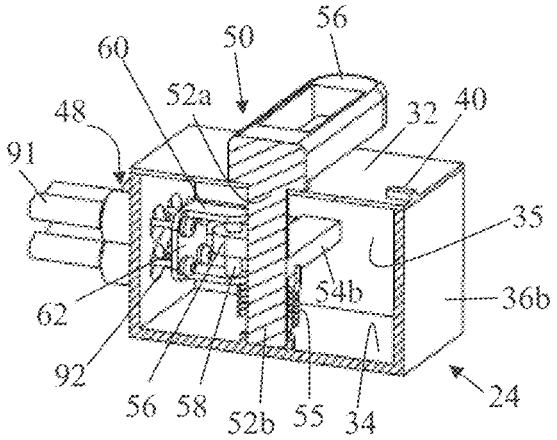
FIG. 6A is a top perspective cross-sectional view of the main lock assembly illustrated in FIG. 5A, taken along line VIA-VIA.
Figure 6B:
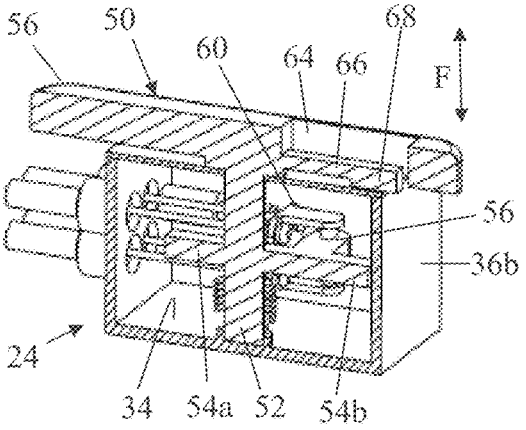
FIG. 6B is a top perspective cross-sectional view of the main lock assembly illustrated in FIG. 5B, taken along line VIB-VIB.

Referring to FIGS. 6A and 6B, the main lock assembly 24 includes a main lock lever 50 configured to actuate the locking and unlocking of the leg assemblies 16*a-d* and leg extensions 17*a-d*. In the illustrated embodiment, the main lock lever 50 is formed as a unitary body and includes a cylindrical pillar 52, a pair of opposing lever arms 54*a* and 54*b* and an elongate lever handle 56. As best shown in FIG. 6A, the pillar 52 has a proximal end 52*a* and a distal end 52*b*. The pillar 52 is entirely inserted through the central opening 38 into the interior chamber 35 of the main lock assembly 24 with the distal end 52*b* being rotatably secured to the second wall 34 of the main lock assembly 24. The proximal end 52*a* of the pillar 52 is orthogonally connected to the lever handle 56, which extends outside of the main lock assembly 24 and along and parallel to the outer surface of the first wall 32 of the main lock assembly 24. The pair of lever arms 54*a* and 54*b* are orthogonally connected to the pillar 52 and generally connected at a mid-point between the proximal and distal ends 54*a*, 54*b* such that the lever arms 54*a*, 54*b* extend in opposite directions and both being parallel to the lever handle 56.

As best seen in FIGS. 6A and 6B, there is a torsion spring 55 near the second wall 34 and into which the distal end 52*b* of the pillar 52 is inserted. When the lever handle 56 is in a locked position shown in FIGS. 5A, 5C and 6A, the torsion spring 55 is in a free configuration, i.e., not being stressed or loaded, however, when the lever handle 56 is in an unlocked position shown in FIGS. 5B, 5D and 6B, the torsion spring 55 is in a loaded configuration, i.e., being deflected. Optionally, the interior chamber 35 of the main lock assembly 24 may include a gas piston (not shown) to soften/dampen the motion/sound of the main lock lever 50 snapping back or returning from the unlocked position to the locked position.

Each lever arm 54*a* and 54*b* includes a respective cam ledge 56 that extends at a right angle from respective one of the lever arms 54*a* and 54*b*, perpendicularly in relation to the lever handle 56 and parallel relative to the first and second walls 32, 34 of the main lock assembly 24. Each cam ledge 56 includes a circular opening (not shown) and a cylindrical shaft 58 rotatably inserted therethrough such that both cylindrical shafts 58 are parallel relative to the pillar 52. Rotatably attached to each shaft 58 is a U-shaped cable retention bracket 60, such as shown in FIG. 6A. A base 62 of the cable retention bracket 60 includes four through holes (not shown) to retain first ends of control or Bowden cables, as will be explained in more detail below.

Referring to FIGS. 5A-6B, one end of the elongate lever handle 56 is a recessed end having a through recess 64 longitudinally extending along the lever handle 56. Within the recess 64, there is a lever finger 66 having a first end 66*a* being connected to the lever handle 56 and a second end 66*b* being a free end. As such, the second end 66*b* of the lever finger 66 is capable to flex along direction F shown in FIG. 6B. The lever finger 66 includes a bulge 68 at the second end 66*b* that extends towards the first wall 32 of the main lock assembly 24.

Figure 8A:
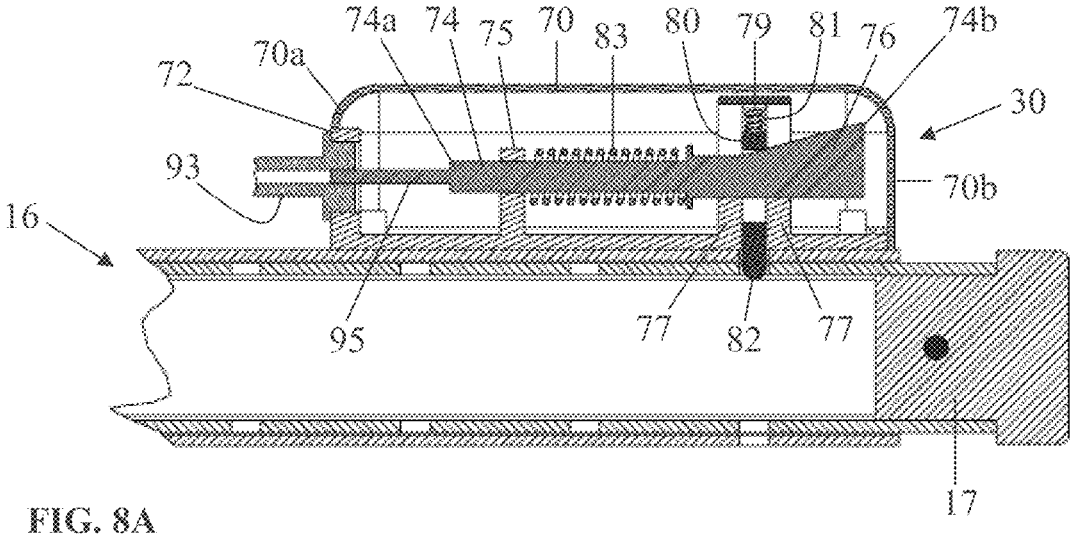
FIG. 8A is a side elevation cross-sectional view of a leg lock assembly with a locking detent engaged in a leg extension, in accordance with the present invention.
Figure 8B:
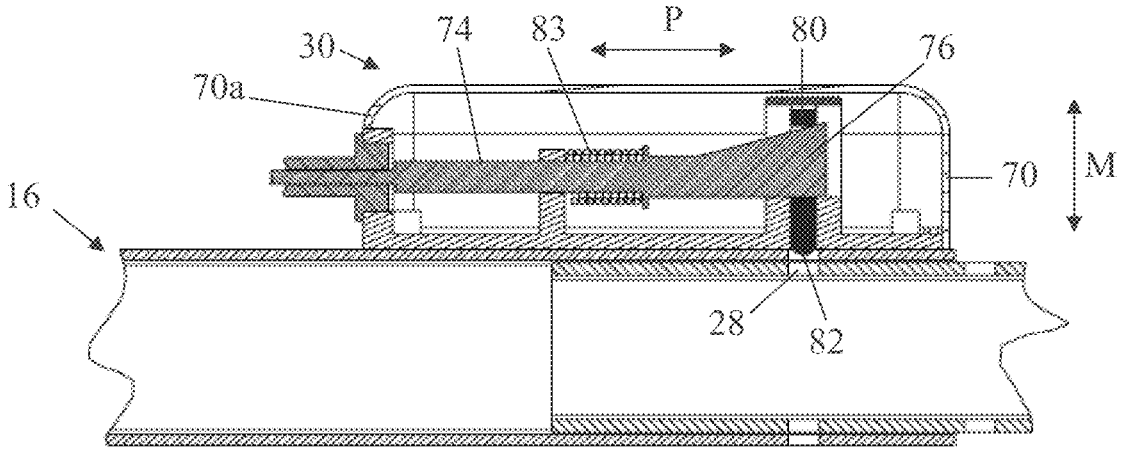
FIG. 8B is a side elevation cross-sectional view of the leg lock assembly of FIG. 8A with the locking detent not being engaged in the leg extension.

With reference to FIGS. 8A and 8B, the leg lock assembly 30 will now be described in more detail. In the illustrated embodiment, the leg lock assembly 30 includes a housing 70 having a proximal end 70*a* and a distal end 70*b*. The proximal end 70*a* has a circular opening 72 therethrough. Enclosed within the housing 70 is a wedge piston 74 that extends in parallel to respective one of the leg assemblies 16*a-d* and is supported by a proximal post 75 and a pair of distal posts 77. The wedge piston 74 has a proximal end 74*a* and a distal end 74*b*, which has a ventrally-extended wedge portion 76. Aligned with the pair of distal posts 77 is a channel 79 that contains a leg latch member 80 slidably movable therein along direction M, shown in FIG. 8B. One end of the leg latch member 80 includes a locking detent 82 and another end is connected to a secondary compression spring 81 disposed within the channel 79. The secondary compression spring 81 is fully decompressed when the locking detent 82 is biased/pushed into one of the positioning holes 28 of respective one of the leg extensions 17*a-d*. The wedge piston 74 is inserted into a primary compression spring 83 disposed between the proximal post 75 and pair of distal posts 77. The primary compression spring 83 is fully decompressed when the distal end 74*b* of the wedge piston 74 is near the distal end 70*b* of the housing 70.

Returning now to FIGS. 2-4, the lock release lever 25 extends from the sidewall 36*b* of the main lock assembly 24 to one of the sidewalls 22 of the seat member 12 and includes a release arm 84 having a first end 84*a* and a second end 84*b* (FIG. 4). The first end 84*a* is coupled to a release handle 85 (FIG. 3). The second end 84*b* includes a tip member (not shown) extending generally at right angle from the second end 84*b* of the release arm 84 towards the main lock tab 40 of the main lock assembly 24. The release arm 84 is connected to the back surface 20 of the seat member 12 by a fulcrum 86 (FIG. 4) and the second end 84*b* is connected to the back surface 20 by a tension spring (not shown) extending in opposite direction from the tip member. It should thus be understood that when the release handle 85 is pressed towards the back surface 20, the release arm pivots so that the tip member rises farther towards the main lock tab 40 thereby deflecting the tension spring.

With continued reference to FIGS. 2-4, the back surface 20 of the seat member 12 also supports a network of control or Bowden cables, hereinafter referred to as a control cable for singular or control cables for plural. A control cable within the scope of the present disclosure is a flexible cable used to transmit mechanical force or energy by the movement of an inner cable relative to a hollow outer cable housing. In the illustrated embodiment of FIGS. 2-4, the foldable chair 10 has four leg assembly control cables 88*a*, 88*b*, 88*c* and 88*d* and four leg extension control cables 90*a*, 90*b*, 90*c* and 90*d*. As best shown in FIG. 4, leg assembly control cables 88*a-d* correspond to respective leg assemblies 16*a-d*. More specifically, each of the leg assembly control cables 88*a-d* selectively actuates either the locking or unlocking of respective one of the leg assemblies 16*a-d* in the folded configuration and in the unfolded configuration. Subsequently, leg extension control cables 90*a-d* correspond to respective leg extensions 17*a-d*. More specifically, each of the leg extension control cables 90*a-d* selectively actuates either the locking or unlocking of respective one of the leg extensions 17*a-d* that is collapsed or deployed.

Figure 7:
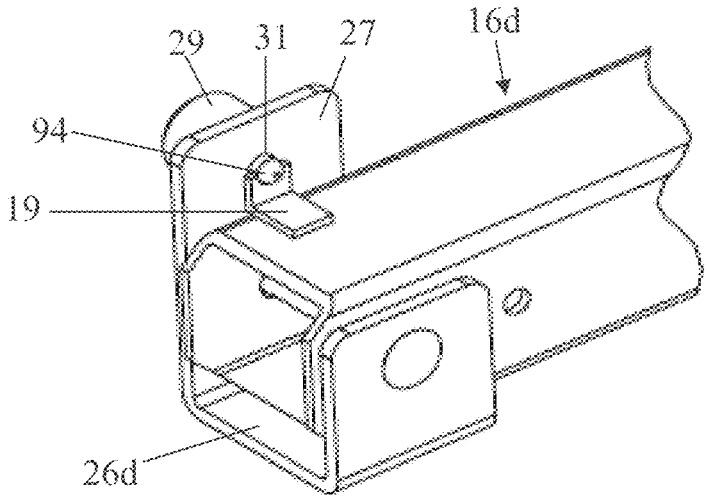
FIG. 7 is an enlarged perspective view of section VII shown in FIG. 4.

Due to substantial similarity and for ease of description, only one of the four leg assembly control cables 88*a-d* and only one of the four leg extension control cables 90*a-d* will be described in more detail. With reference to FIGS. 4, 6A and 7, the leg assembly control cable 88*d* has an outer cable 91, an inner cable 92 (FIG. 6A) and two opposing ends—a first end and a second end. The outer cable 91 of the first end is received by one of the four round collars 48 while the inner cable 92 of the first end is coupled to the base 62 of the cable retention bracket 60, such as shown in FIG. 6A. The outer cable 91 of the second end is received in a hinge bracket neck 29 (FIG. 7) of the hinge bracket 26*d*. The inner cable 92 of the second end is connected to a leg assembly locking pin 94 (FIG. 7) that is configured to extend and retract within the hole 31 in the arm 27 of the hinge bracket 26*d*. For example, when the leg assembly locking pin 94 is extended, the locking pin 94 is configured to engage a notch (not shown) in the catch member 19 so as to lock the leg assembly 16*d* in the folded configuration.

Turning now to FIGS. 4, 6A, 8A and 8B, the leg extension control cable 90*d* has an outer cable 93, an inner cable 95 (FIG. 6A) and two opposing ends—a first end and a second end. The outer cable 93 of the first end is received by one of the four round collars 48 while the inner cable 95 of the first end is coupled to the base 62 of the cable retention bracket 60, such as shown in FIG. 6A. The outer cable 93 of the second end is received in the circular opening 72 (FIG. 8A) of the housing 70 of the leg lock assembly 30. The inner cable 95 of the second end is connected to the wedge piston 74 (FIG. 8A) that is configured to move within the leg assembly 30 along direction P, as shown in FIG. 8B. For example, when the leg extension control cable 90*d* is actuated by rotating the lever handle 56, the second end of the inner cable 95 pulls the wedge piston 74 towards the proximal end 70*a* of the housing 70, such as shown in FIG. 8B. When the wedge piston 74 is pulled, the ventrally-extended wedge portion 76 forces the leg latch member 80 to gradually slide away from the leg assembly 16, thereby removing the locking decent 82 out of one of the positioning holes 28 to allow the leg extension 17 to move freely within the leg assembly 16 such as to collapse or farther extend.

Figure 9:
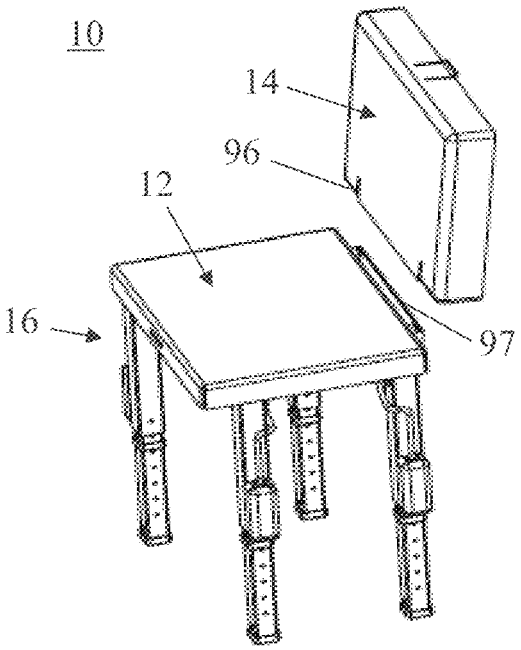
FIG. 9 is a top perspective view of the foldable chair illustrated in FIG. 1, shown with the backrest member being detached from the foldable chair.
Figure 10:
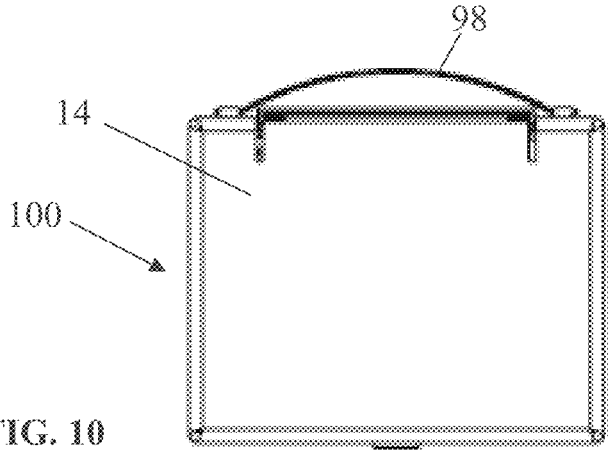
FIG. 10 is side elevation view of a portable case that the foldable chair can be formed into, in accordance with the present invention.
Figure 11:
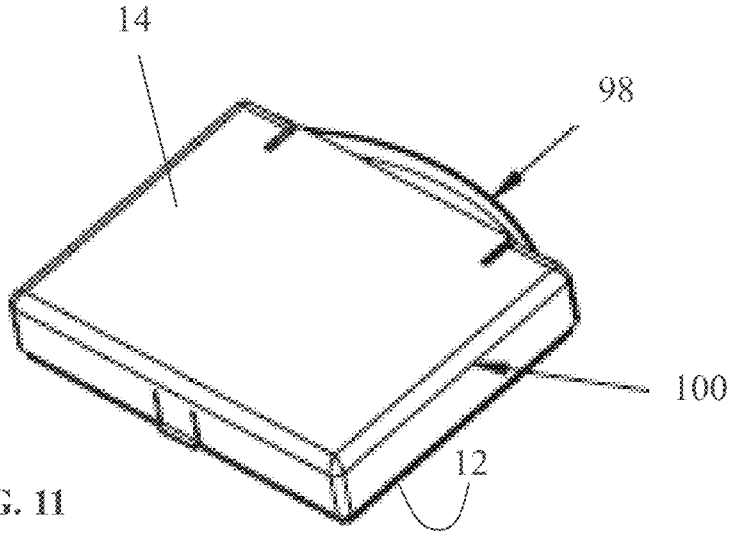
FIG. 11 is a top perspective view of the portable case illustrated in FIG. 10.

With reference to FIGS. 9-11, the backrest member 14 has a similar shape as the seat member 12, described above. More specifically, the backrest member 14 has a front surface configured to support the user, a back surface and a plurality of sidewalls forming a cavity therebetween. The backrest member 14 is configured to serve as a second half of the portable case 100, and thus has sufficiently larger dimensions than the seat member 12 to cover the back surface 20 and the sidewalls 22 of the seat member 12, such as shown in FIGS. 10 and 11. The back rest member 14 includes a pair of incisions 96 that are configured to align and mate with a mounting bracket 97 of the seat member 12 (FIG. 9) so that the backrest member 14 can removably engage the seat member 12 in a generally upright position relative to the seat member 12. It should be apparent that the backrest member 14 can selectively disengage the seat member 12, and, when the leg assemblies 16 are in the folded configuration, the seating member 14 can hingedly engage the seat member 12 by covering the back surface 20 of the seat member 12 to form the portable case 100, as shown in FIGS. 10 and 11. It is further envisioned that one of the sidewalls of the backrest member 14 may include a handle 98 to aid the user in carrying the case 100.

In operation, when the leg assemblies 16 are in the folded configuration, shown in FIGS. 3 and 4, the handle 56 of the main lock lever 50 can be manually rotated (clockwise and 90 degrees) from a closed position (FIG. 5A) into an open position (FIG. 5B). Note that when the main lock lever 50 is in the closed position, the leg assemblies 16*a*-*d* are locked in the folded configuration by respective one of the leg assembly locking pins 94. When the main lock lever 50 is in the open position, the inner cable 92 of the control cables 88*a*-*d* is pulled thereby unlocking the leg assemblies 16*a*-*d* and allowing the leg assemblies 16*a*-*d* to be rotated in the unfolded configuration. Further, when the main lock lever 50 is in the open position, the leg extensions 17*a*-*d* also become unlocked by the motion of the wedge pistons 74 causing the locking detents 82 to disengage respective one of the positioning holes 28.

The release lever 25 can then be used to lock the leg assemblies 16*a*-*d* and leg extensions 17*a*-*d* by pressing the release handle 85 of the release lever 25 towards the back surface 20 of the seat member 12. When the release handle 85 is pressed, the tip member of the second end 84*b* pushes or flexes the second end 66*b* of the lever finger 66 away from the seat member 12. As the second end 66*b* is flexed, the main lock tab 40, which prevents the handle 56 of the main lock lever 50 from moving into the closed position as shown in FIG. 5B, is no longer an obstacle and the main lock lever 50, under the force of the torsion spring 55, returns to the closed position.

Changes and modifications in the specifically described embodiments may be carried out without departing from the principles of the present invention, which is intended to be limited only by the scope of the appended claims, as interpreted according to the principles of patent law including the doctrine of equivalents.

The invention claimed is:

1. A foldable chair comprising:

a seat member having a front side for supporting a user and a back side;

a backrest member having a front surface for supporting the user and a back surface;

a plurality of legs, each of the legs is pivotably connected to the back side of the seat member and each leg is adapted to pivot from a folded configuration where each leg is generally parallel to the back side of the seat member to an unfolded configuration where each leg is generally transverse to the back side of the seat member; and a main lock assembly connected to the back side of the seat member and operable to lock and unlock the legs in the folded and unfolded configurations;

wherein the backrest and seat members are configured to selectively form a portable case by the backrest member hingedly engaging the seat member to enclose at least the back side of the seat member.

2. The foldable chair of claim 1, wherein each of the plurality of legs includes a leg extension selectively slidable therein from a collapsed position to a deployed position.

3. The foldable chair of claim 2, wherein each of the legs includes a leg lock assembly configured to interact with the main lock assembly and operable to lock and unlock respective one of the leg extensions in the collapsed and deployed positions.

4. The foldable chair of claim 3 further comprising a second set of control cables, each cable of the second set of control cables extending from the main lock assembly to respective one of the leg lock assemblies.

5. The foldable chair of claim 2, wherein the main lock assembly includes a main lock lever that can be selectively rotated from a closed position to an open position to unlock the legs in the folded and unfolded configurations and unlock the leg extensions in the collapsed and deployed positions.

6. The foldable chair of claim 5 further comprising a lock release lever that can be selectively pressed to lock the legs in the folded and unfolded configurations and lock the leg extensions in the collapsed and deployed positions.

7. The foldable chair of claim 6, wherein the lock release lever, when the main lock lever is in the open position, can be pressed to actuate the main lock lever to move from the open position to the closed position causing the main lock assembly to lock the legs in the folded and unfolded configurations and lock the leg extensions in the collapsed and deployed positions.

8. The foldable chair of claim 1 further comprising a first set of control cables, each cable of the first set of control cables extending from the main lock assembly to respective one of the plurality of legs.

9. The foldable chair of claim 1, wherein the backrest member, when each of the plurality of legs is in the folded configuration and respective one of the leg extensions is in the collapsed position, can hingedly engage the seat member to enclose the plurality of legs between the back side of the seat member and the back surface of the backrest member.

10. A foldable chair comprising:

a seat member having a front side for supporting a user and a back side;

a backrest member having a front surface for supporting the user and a back surface;

a plurality of leg assemblies pivotably connected to the back side of the seat member, each of the leg assemblies including a leg extension slidable from a collapsed position to a deployed position, wherein each of the leg assemblies is adapted to pivot from a folded configuration where each leg is generally adjacent and parallel to the back side of the seat member to an unfolded configuration where each leg is generally transverse to the back side of the seat member; and a main lock assembly connected to the back side of the seat member and operable to lock and unlock the leg assemblies in the folded and unfolded configurations;

wherein the backrest and seat members are configured to selectively form a portable case having the leg assemblies in the folded configuration therein by the backrest member hingedly engaging the seat member to cover at least the back side of the seat member.

11. The foldable chair of claim 10, wherein each of the leg assemblies includes a leg lock assembly configured to interact with the main lock assembly and operable to lock and unlock respective one of the leg extensions in the collapsed and deployed positions.

12. The foldable chair of claim 11 further comprising a second set of control cables, each cable of the second set of control cables extending from the main lock assembly to respective one of the leg lock assemblies.

13. The foldable chair of claim 10 further comprising a first set of control cables, each cable of the first set of control cables extending from the main lock assembly to respective one of the leg assemblies.

14. The foldable chair of claim 10, wherein the main lock assembly includes a main lock lever that can be selectively rotated from a closed position to an open position to unlock the leg assemblies in the folded and unfolded configurations and unlock the leg extensions in the collapsed and deployed positions.

15. The foldable chair of claim 14 further comprising a lock release lever that can be selectively pressed to lock the leg assemblies in the folded and unfolded configurations and lock the leg extensions in the collapsed and deployed positions.

16. The foldable chair of claim 15, wherein the lock release lever, when the main lock lever is in the open position, can be pressed to actuate the main lock lever to move from the open position to the closed position causing the main lock assembly to lock the leg assemblies in the folded and unfolded configurations and lock the leg extensions in the collapsed and deployed positions.

17. The foldable chair of claim 10, wherein the backrest member, when each of the plurality of leg assemblies is in the folded configuration and respective one of the leg extensions is in the collapsed position, can hingedly engage the seat member to enclose the plurality of legs between the back side of the seat member and the back surface of the backrest member.

18. A foldable chair comprising:

a seat member having a front side for supporting a user and a back side;

a backrest member having a front surface for supporting the user and a back surface;

a plurality of leg assemblies pivotably connected to the back side of the seat member, each of the leg assemblies including a leg extension slidable from a collapsed position to a deployed position, wherein each of the leg assemblies is adapted to pivot from a folded configuration where each leg is generally adjacent and parallel to the back side of the seat member to an unfolded configuration where each leg is generally transverse to the back side of the seat member; and a main lock assembly connected to the back side of the seat member and operable to lock and unlock the leg assemblies in the folded and unfolded configurations and operable to lock and unlock the leg extensions in the deployed and collapsed positions;

wherein the backrest and seat members are configured to selectively form a portable case having the leg assemblies in the folded configuration therein by the backrest member hingedly engaging the seat member to cover at least the back side of the seat member.

* * * * *